US005097510A

United States Patent [19]

Graupe

[11] Patent Number: 5,097,510

[45] Date of Patent: Mar. 17, 1992

[54] ARTIFICIAL INTELLIGENCE PATTERN-RECOGNITION-BASED NOISE REDUCTION SYSTEM FOR SPEECH PROCESSING

[75] Inventor: Daniel Graupe, Highland Park, Ill.

[73] Assignee: GS Systems, Inc., Highland Park, Ill.

[21] Appl. No.: 432,525

[22] Filed: Nov. 7, 1989

[51] Int. Cl.[5] ..... G10L 3/02

[52] U.S. Cl. ..... 381/47

[58] Field of Search ..... 364/724.19, 724.2; 381/71, 73.1, 94, 46, 47

[56] References Cited

U.S. PATENT DOCUMENTS

| | | | |
|---|---|---|---|
| 4,628,529 | 12/1986 | Borth et al. | 381/94 |
| 4,630,304 | 12/1986 | Borth et al. | 381/47 |
| 4,658,426 | 4/1987 | Chabries et al. | 381/94 |
| 4,688,256 | 8/1987 | Yasunaga | 381/46 |
| 4,747,143 | 5/1988 | Kroeger et al. | 381/47 |
| 4,764,966 | 8/1988 | Einkauf et al. | 381/46 |
| 4,918,732 | 4/1990 | Gerson et al. | 381/46 |
| 4,942,546 | 7/1990 | Rambaut | 381/94 |

*Primary Examiner*—Dale M. Shaw
*Assistant Examiner*—Michelle Doerrler
*Attorney, Agent, or Firm*—Sitrick & Sitrick

[57] ABSTRACT

A system is provided to reduce noise from a signal of speech that is contaminated by noise. The present system employs an artificial intelligence that is capable of deciding upon the adjustment of a filter subsystem by distinguishing between noise and speech in the spectrum of the incoming signal of speech plus noise. The system does this by testing the pattern of a power or envelope function of the frequency spectrum of the incoming signal. The system determines that the fast changing portions of that envelope denote speech whereas the residual is determined to be the frequency distribution of the noise power. This determination is done while examining either the whole spectrum, or frequency bands thereof, regardless of where the maximum of the spectrum lies. In another embodiment of the invention, a feedback loop is incorporated which provides incremental adjustments to the filter by employing a gradient search procedure to attempt to increase certain speech-like features in the system's output. The present system does not require consideration of minima of functions of the incoming signal or pauses in speech. Instead, the present system employs an artificial intelligence system to which is input the envelope pattern of the incoming signal of speech and noise. The present system then filters out of this envelope signal the rapidly changing variations of the envelope over fixed time windows.

22 Claims, 3 Drawing Sheets

ARTIFICIAL INTELLIGENCE PATTERN-RECOGNITION-BASED NOISE REDUCTION SYSTEM FOR SPEECH PROCESSING

This invention is related to a system to reduce noise and more particularly to a system to reduce noise from a signal of speech that is contaminated by noise. Prior single-microphone systems for reducing noise that contaminates speech, such as Graupe and Causey (U.S. Pat. No. 4,025,721 or 4,185,168) provide for the identification of a minimum of the envelope or the average power of the incoming signal, which is the sum of speech plus noise, and the determination of the parameters of the incoming signal at that minimum which was assumed to be a pause in speech or the time where only noise was presented such that these parameters were determined to be noise parameters. These prior systems were limitted in both the scope of applications for use, and in the manner of realization, being restricted to the use of an analog array of band pass filters.

In accordance with the present invention a system is provided to reduce noise from a signal of speech that is contaminated by noise. The present system employs an artificial intelligence that is capable of deciding upon the adjustment of a filter subsystem by distinguishing between noise and speech in the spectrum of the incoming signal of speech plus noise by testing the pattern of a power or envelope function of the frequency spectrum of the incoming signal and deciding that fast changing portions of that envelope denote speech whereas the residual is determined to be the frequency distribution of the noise power, while examining either the whole spectrum or frequency bands thereof, regardless of where the maximum of the spectrum lies. In another embodiment of the invention, a feedback loop is incorporated which provides incremental adjustments to the filter by employing a gradient search procedure to attempt to increase certain speech-like features in the system's output. The present system does not require consideration of minima of functions of the incoming signal or pauses in speech. Instead, the present system employs an artificial intelligence system to which is input the envelope pattern of the incoming signal of speech and noise. The present system then filters out of this envelope signal the rapidly changing variations of the envelope over fixed time windows.

BRIEF DESCRIPTION OF THE DRAWINGS

The present invention may be better understood by reference to the detailed description in conjuction with the drawings wherein.

DETAILED DESCRIPTION OF THE DRAWINGS

Figure 1:
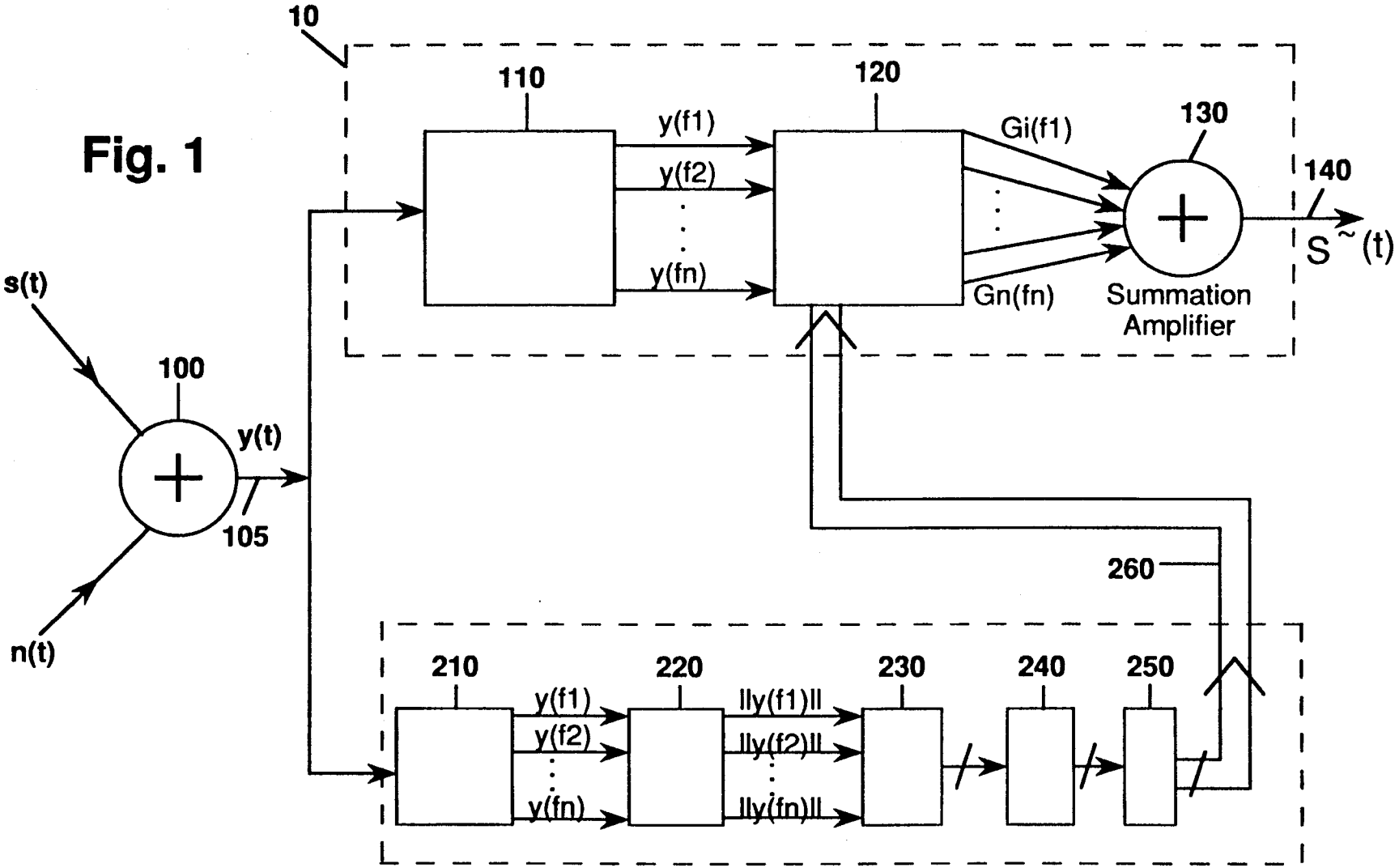
FIG. 1 is an electrical block diagram of the system of the present invention, without feedback.

The present system does not require consideration of minima of functions of the incoming signal or pauses in speech. Instead, the present system employs an artificial intelligence system to which is input the envelope pattern of the incoming signal of speech and noise (see FIG. 1). This input signal, or incoming signal is further described with reference to FIG. 2. The present system then filters out of this envelope signal the rapidly changing variations of the envelope over fixed time windows. These rapidly changing variations are not necessarily maxima as is further described with reference to FIG. 3.

The rapidly changing variations are variations lasting no more than some predetermined time threshold durations. The input signal envelopes are evaluated at various frequency bands, or alternatively the envelope of a Discrete Fourier transform (DFT) of the total incoming signal. The predetermined time durations are different, for different frequencies in the multiband case or of the FFT (DFT). The artificial intelligence system subsequently determines the envelope level of the thus filtered input signal envelopes to represent the spectral level of the noise over the appropriate band or over the discrete frequency considered in the DFT.

The input signal may be comprised of a single envelope, or may be simultaneously comprised of multiple envelopes for the multiple bands or spectral levels. Each element of speech, or phoneme, has energy at a different frequency. These frequencies are well documented, such as in the book entitled *Hearing Aids Assessment and Use in Audiological Reassessment,* by W. R. Hodkin and R. W. Skinner, published by Williams and Wilkins, Baltimore, 1977.

Different predetermined time threshold durations are employed at different frequency bands due to the fact that low frequency (approximately, below 1.2 Kilo-Hertz in the preferred embodiment) phonemes that correspond to voiced speech have a duration (approximately 40 to 150 milliseconds) that is considerably longer than high frequency (approximately, above 1.2 KHz in the preferred embodiment) phonemes that correspond to unvoiced speech, which have a relatively shorter duration (approximately 3 to 30 milliseconds).

The low frequency/high frequency breaks chosen for the preferred embodiment are below 1200 Hertz and above 1200 Hertz respectively. Alternatively, other breaks can be chosen, for example, 800, 1000 or 1500 Hertz. Additionally, multiple breaks or sub-breaks can be chosen, each having a distinct and separate predetermined time threshold duration.

In the preferred embodiment, the predetermined time threshold duration is approximately 120 milliseconds for the low frequency phonemes that correspond to voiced speech (below 1200 Hertz). This predetermined time threshold duration can be in the range of 100 to 150 milliseconds.

In the preferred embodiment, the predetermined time threshold duration is approximately 40 milliseconds for the high frequency phonemes that correspond to unvoiced speech (above 1200 Hertz). This predetermined time threshold duration can be in the range of 25 to 40 milliseconds.

Thus, those rapidly changing variations lasting less than the respective predetermined time threshold duration are considered speech by the system, while those rapidly changing variations lasting less than the respective predetermined time threshold duration are considered noise by the system.

The system accounts for the fact that past variations in the input signal envelopes at different frequencies or frequency bands are the envelopes of the speech component of the incoming signal which rapidly move in time with the time-progression of speech from one speech phoneme to the next, which in any normal speech of any human language are different in frequency from one phoneme to the next, while the noise to be removed by the present system does not jump around in its frequency location at such rate but is considered to change in frequency location and in intensity at a given frequency or frequency band at a lower rate.

Once the frequency content of the noise components of the incoming signal has thus been determined via the envelope filtering above, the artificial intelligence subsystem (see FIG. controller subsystem 250) will recognize one of 4 situations, namely (I.) no noise (noise at a level below a given level three), (II.) white noise, (noise having a substantially flat spectrum according to threshold level parameters at various frequencies or frequency bands as stored in the artificial intelligence recognizer sub-system), (III.) Babble noise (namely noise due to several speakers speaking simultaneously at the background such that their phonemes mix to form an envelope component that lasts longer at a given frequency location than had it been due to a single-speaker's speech signal; and (IV.) noise other than (I) to (III) (namely, noise that peaks at one or several frequency ranges but which is not babble noise).

Having distinguished between the 4 categories (I) to (IV) above, the artificial intelligence system selects a respective manner in which to filter the incoming signal via a filter sub-system, which manner is different for each of the classes (I) to (IV).

This filter is bypassed for class (I):

For class (II): the filter is set to adjust for average speech conditions such that speech intelligibility is maximized while noise effect is minimized. This results in a suppression (notching) of the lowest and highest frequency bands or ends of the spectrum, i.e. approximately below 400 Hz and approximately above 2.6 KHz.

For Class (III): the filter is be set to notch out low frequencies where most babble energy is concentrated.

For Class (IV): the filter is set to notch out the frequency base where the post-filtered envelope maximizes, with moderate suppression of bands where the envelope is still relatively high, while ensuring that still at least approximately one half of the (logarithmic) total frequency range considered (from 200 Hz to 3200 Hz) is unsuppressed. Furthermore, noting that speech intelligibility is very much concentrated in the high frequencies (above 2000 KHZ), when the artificial intelligence system determines that the noise to be notched out is at frequencies below about 1500 Hz, then the bands from approximately 2000 Hz and higher are boosted (by up to 10 to 15 decibels(dB)).

In one preferred embodiment, the filter sub-system is an array of band-pass filters. Alternatively, the filter subsystem can equally well be realized by a microcomputer system, a digital signal processor, or a FFT(Fast Fourier Transform) or DFT(Discrete Fourier Transform) integrated circuit or system. In fact, the entire system of the present invention, both the decision and control channel and the filtering channel can be realized as a single microprocessor or DSP based system, wherein the microprocessor stores the input signal envelopes parameters, analyzes each component, computes respective gain for each component, and then adjusts the gain for each component responsive to the stored parameters and in accordance with the teachings of the present invention to provide for optimization.

In another embodiment of the system (see FIG. 4), a feed-back channel (see FIG. 5) is incorporated in the noise reduction system above, which employs a voiced-/unvoiced discriminator based on sharp cut-off high pass and low pass filters to divide the speech component s(t) into its high frequency and low frequency parts. The overall output of the noise reduction system s(t) (see FIG. 4 or 5) is input into the feedback channel, which examines the system's output to determine if it is substantially speech, by examining the existence of speech features of the voiced/unvoiced structure of speech, both in frequency content and in the time duration of the respective voiced and unvoiced phonemes of speech.

Consequently, if the above discriminator decides that, over a time window (on the order of approximately 100 to 150 milliseconds), the output signal s(t) does not possess the above features of frequency content and the related time duration, namely low frequency voiced phonemes lasting approximately 50 millisec. to 150 millisec. and high frequency (unvoiced) phonemes lasting below approximately 20 millisec., than an internal signal denoted as Q is produced over a duration $T_q$ within a predetermined time interval $T_w$, the ratio $T_q/T_w$ being denoted as $R_q$. Subsequently, a gradient search procedure or circuit is incorporated in the feedback channel to vary the gain parameters of the filter subsystem (channel) of the main system (as in FIGS. 4 or 5) within some predetermined constrained range of values to reduce $R_q$, namely, to enhance the speech-like features of s(t) and hence to obtain a more noise-free s(t) at the system output.

Referring again to FIG. 1, an electrical block diagram of the system of the present invention, without feedback, is illustrated. The artificial intelligence pattern recognition based noise reduction system for speech processing as illustrated in FIG. 1 is a signal processing system, responsive to an input signal y(t), 105, comprised of a speech signal s(t) plus a noise signal n(t), which are summed by the receiving source 100, which provides the input signal y(t), 105, therefrom. The system is comprised of a filter channel 10, and a decision and control channel, 20. The input signal y(t), 105, is input to each of the filter channel 10, and a decision and control channel, 20.

The decision and control channel 20 provides means for outputting decision control parameter signals 260 responsive to the input signal y(t), 105. The decision and control channel 20 is further comprised of a frequency subsystem 210, an energy subsystem 220, and a pattern classification subsystem comprising a filtering subsystem 230, a pattern classification subsystem 240 and a controller subsystem 250.

The frequency subsystem 210 provides a means for deriving frequency components of the input signal, for providing respective frequency component outputs $[y(f_1), y(f_2), \ldots y(f_n)]$.

The energy subsystem 220 provides a means for deriving energy components $[||y(f_1)||, ||y(f_2)||, \ldots ||y(f_n)||$ for each of the frequency components responsive to said frequency component outputs where $||y(f_n)||$ denotes the absolute value of the amplitude of the respective frequency component. The energy subsystem 220 provides a power analyzer, and can be implemented in many different ways, such as a DFT power analyzer, an FFT analyzer, a squarer circuit with a smoother circuit, etc.

The pattern classification subsystem is illustrated in FIG. 1 as comprising a filtering subsystem 230 for filtering of the time varying peaks in $||y||$ and a pattern classification subsystem 240 for classification of noise out of its frequency distribution, and a controller subsystem 250 for determination of the adjustments of gains (the gain vector settings, or filter's parameter settings) at the various frequencies, using artificial intelligence type pattern recognition decisions in accordance with the teachings of the present invention.

The pattern classification subsystem provides a means for selectively removing fast (or rapidly changing) time variations determined to be changing at a rate faster than a defined threshold rate of the input signal, to provide a residual output, where the variations represent variations in the power of the speech signal for the respective frequency component, wherein the residual output corresponds to the power of the noise signal for the respective frequency component, and wherein the outputs at different frequency components constitute the control parameter signals 260.

The filter channel 10 is further comprised of a frequency subsystem 110, and a gain vector subsystem 120 providing separate gain control at multiple frequency bands.

The frequency subsystem 110 provides a means for deriving frequency components of the input signal, for providing respective frequency component outputs $[y(f_1), y(f_2), \ldots y(f_n)]$.

The filter channel 10 provides means for selectively filtering the input signal y(t), 105, to reduce noise responsive to the control parameter signals 260 and the input signal 105, for providing a filter output signal $s\sim(t)$,140, corresponding to the input signal with reduced noise.

The filter channel's gain vector subsystem provides means for adjusting gain parameters of the frequency subsystem 110 outputs $y(f_n)$, responsive to the control parameter signals 260, so as to selectively vary the filter channel 10 gain vector subsystem 120 frequency response for each frequency component.

The fast-time variations can be determined over a frequency range covering the whole frequency spectrum of speech, or alternatively subparts thereof. The fast time variations can be determined over frequency ranges each covering a frequency band within the frequency spectrum of speech.

The defined threshold rate is related to the particular frequency component being processed.

The energy function can be determined as the sample variances of the respective frequency components.

The frequency components of the input signal can be Discrete Fourier Transform (DFT) parameters of the input signal, and the decision and control channel 20 can be comprised of a DFT analyzer subsystem 210 for selectively outputting the DFT parameters for the input signal responsive to the input signal.

Alternatively, the frequency components of the input signal can be determined by a subsystem comprising an array of band pass filters responsive to the input signal. This array of band pass filters simultaneously produces the frequency components outputs of the decision and control channel 20, wherein in place of the subsystem 110, the outputs from each band pass filter is also subsequently passed to the filter channel 10 through respective gain elements of the gain vector subsystem 120 for each frequency band, wherein gain value is determined responsive to the control parameter outputs 260.

The gain of the filter channel gain vector subsystem 120, is in a preferred embodiment, determined responsive to an artificial intelligence controller subsystem 250 in the decision and control channel 20. In one mode, this controller subsystem 250 determines when the power of the noise is substantially equal over the whole range of frequencies considered, and responsive to that determination it activates a white noise control mode wherein the gains of the highest and the lowest end of the frequency range considered are suppressed. In a preferred embodiment, the gains of the highest and lowest end of the frequency range considered are suppresses to a gain setting of below 0.1 (−20 dB).

In another mode, the controller subsystem 250 activates a babble noise mode wherein the low frequency range of the filter is strongly suppressed, whereas the high frequency range is at most slightly enhanced, responsive to determining that the power of the noise determined by the decision and control channel is substantially high at the low end of the frequency range for frequencies up to approximately 1000 Hertz, and at the same time, the power of the noise at the high end of the frequency range is determined to be non-zero, and the changes in the power at said high frequency range are determined to occur at a rate that is considerably higher than determined rate associated with for ordinary speech.

The decision and control channel 20 outputs control parameter signals 260, via the controller subsystem 250, such that the gain of the higher frequencies is substantially boosted, while the low frequency range of the filter where noise lies is strongly suppressed, responsive to a determination by the decision and control channel 20 that most of the power of the noise is determined to be substantially high at a frequency range located below a predefined maximal frequency and that only a little noise power exists below a predefined threshold level above that frequency, wherein the decision and control channel 20 controller subsystem 250 determines the noise to be low frequency noise.

Figure 2:
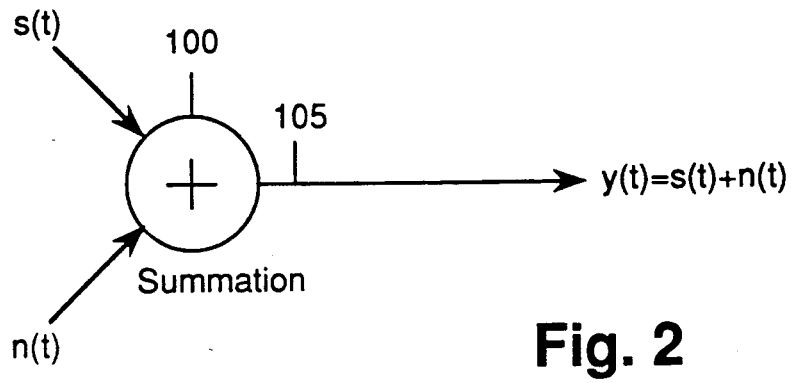
FIG. 2 illustrates the incoming signal and its component parts.
Figure 3:
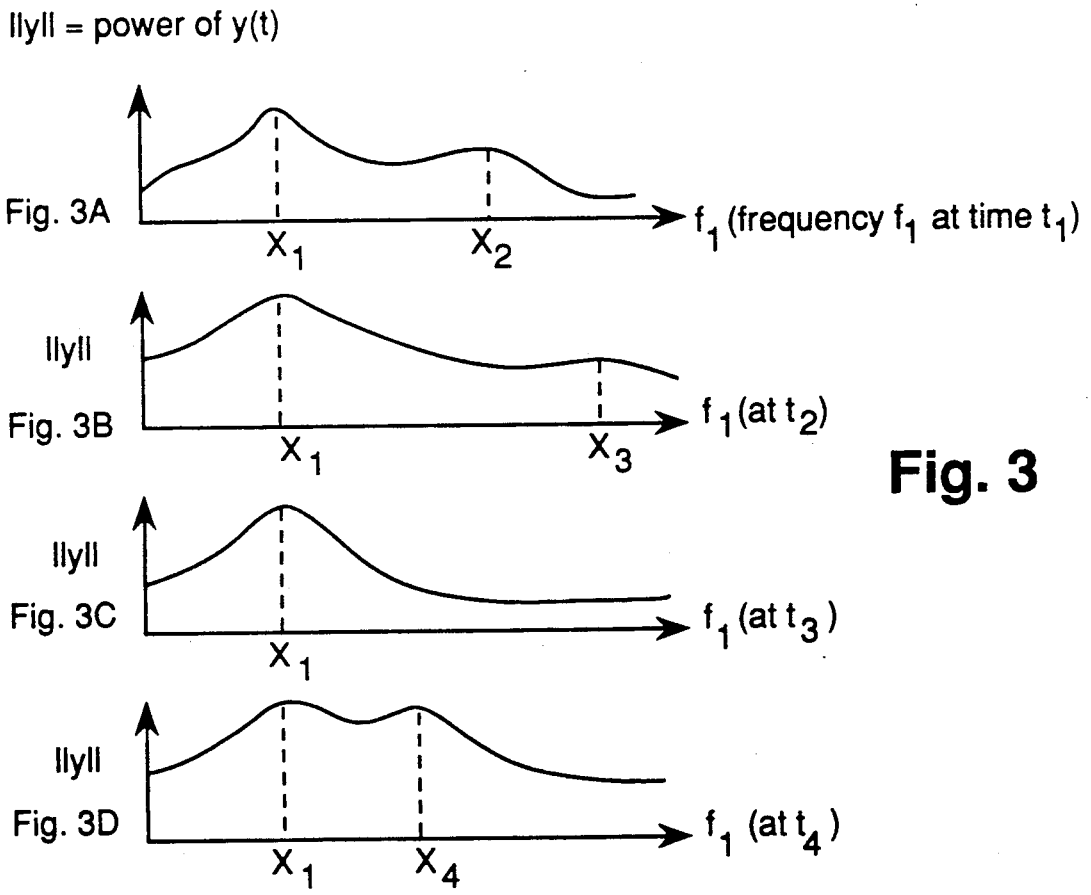
FIGS. 3A–D illustrate the incoming signal envelopes at successive time instances.

FIG. 2 illustrates the incoming signal and its component parts. A sound receiver 100, such as the human ear or a microphone, provides for a summation of the incoming speech signal s(t) and the incoming noise signal n(t). The output from the sound receiver 100 is the input signal incoming signal y(t), 105, where $y(t)=s(t)+n(t)$.

FIGS. 3A-D illustrate the frequency distribution of the incoming signal y(t) envelope at different times, illustrating the discrimination between speech and noise according to patterns of power of the incoming signal. FIGS. 3A-D illustrate the frequency distribution of the incoming signal y(t) envelope at respective successive time instances $t_1$, $t_2$, $t_3$, and $t_4$. FIGS. 3A-3D indicate that the fast changing variation (peak) at position $X_1$ is stationary for all times $t_1$ to $t_4$ and hence indicates noise power, whereas the peaks at $X_2$, $X_3$ and $X_4$ are short lived (non-repeating over the time samples), indicating power to speech phonemes.

Figure 4:
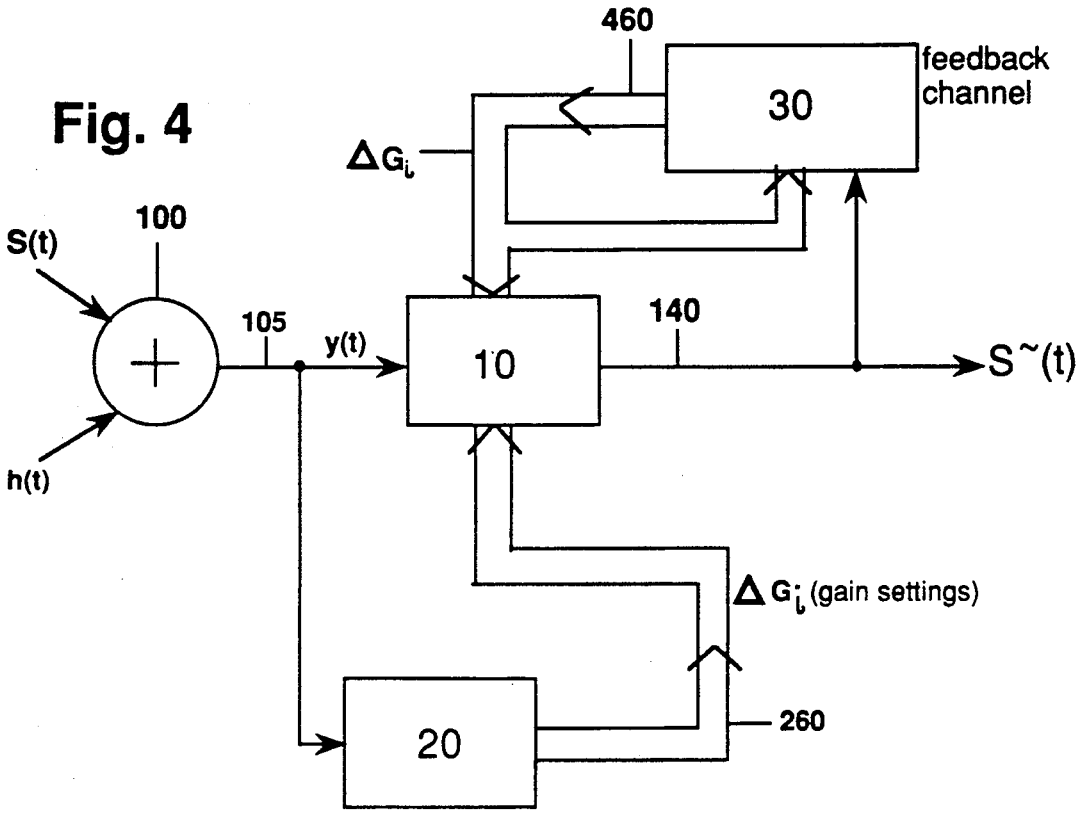
FIG. 4 is an electrical block diagram of the system of the FIG. 1 with the addition of a feedback channel; and, FIG. 5 is an electrical block diagram of the feedback channel of FIG. 4.

FIG. 4 is an electrical block diagram of the system of the FIG. 1, illustrating the receiver 100 providing the input signal y(t), 105, coupled to the inputs of the decision and control channel 20 and the filter channel 10, with the control parameter outputs 260 of the decision and control channel 20 coupling gain control settings $G_i$ to the filter channel 10, with the addition of a feedback channel 30. The feedback channel 30 has the system output $s\sim(t)$, 140, coupled to its input, and provides an output $\sim G_i$ coupled as feedback to both the feedback channel 30 and to the filter channel 10 for providing for adaptive changes to the gain settings of the filter channel 10.

Figure 5:
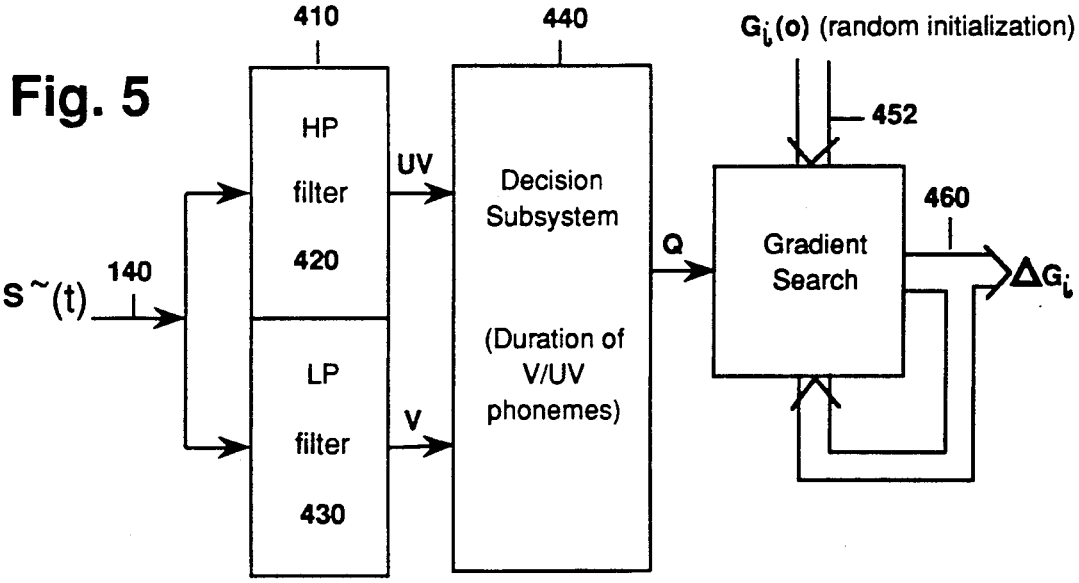

FIG. 5 is an electrical block diagram of the feedback channel 30 of FIG. 4. The feedback channel 30 is comprised of a passband filter subsystem 410, a decision subsystem 440, and a Gradient Search subsystem 450. The passband filter subsystem 410 is comprising a High Pass filter 420 and a Low Pass filter 430. The system output $s\sim(t)$, 140, is coupled to the inputs of each of the High Pass filter 420 and the Low Pass filter 430. As discussed above herein, the High Pass filter subsystem 420 provides an output responsive to the detection of UnVoiced speech phonemes (UV), while the Low Pass filter subsystem 430 provides an output responsive to the detection of Voiced speech phonemes (V). The UV and V outputs are coupled to the input of the Decision subsystem 440, which in accordance with the teachings of the present invention, provides an output Q responsive to a determination of the duration of the respective V and UV outputs corresponding to voiced and unvoiced phonemes. The Q output is coupled to the input of the Gradient Search subsystem 450, which in accordance with the teachings of the present invention, provides an output $\sim G_i$, 460, which provides signals for varying the gain settings of the filter channel 10. The output $\sim G_i$, 460, is also coupled back as feedback to the Gradient Search subsystem 450. Additionally, an initial set of random initialization parameters $\sim G_i(O)$, 452, are provided as an additional initial input to the Gradient Search subsystem 450.

While there have been described herein various specific embodiments, it will be appreciated by those skilled in the art that various other embodiments are possible in accordance with the teachings of the present invention. Therefore the scope of the invention is not meant to be limited by the disclosed embodiments, but is defined by the appended claims.

What is claimed is:

1. A signal processing system, responsive to an input signal comprised of a speech signal plus a noise signal, said system comprising:

decision and control means for outputting decision control parameter signals responsive to the input signal, further comprising frequency subsystem means for deriving frequency components of the input signal, for providing respective frequency component outputs, energy subsystem means for deriving power components for each of said frequency components responsive to said frequency component outputs, comparator means for determining when the input signal has fast time variations changing at a rate faster than a defined threshold rate, responsive to said energy subsystem means;

pattern classification subsystem means, responsive to the comparator means, the energy subsystem means and the input signal, for selectively removing the fast time variations determined to be changing at a rate faster than said defined threshold rate of the input signal, to provide a residual output, wherein said variations represent variations over time in the power components of the speech signal for said frequency component, wherein said residual output corresponds to the power components of the noise signal for said frequency component, and wherein said residual outputs at different frequency components constitute said decision control parameter signals;

filter means, for selectively filtering the input signal to reduce noise responsive to said decision control parameter signals and the input signal, for providing a filter output signal corresponding to the input signal with reduced noise.

2. The system of claim 1 wherein said filter means is further comprised of:

adjustment means for adjusting gain parameters of said filter means responsive to said control parameter signals, so as to selectively vary said filter means frequency response for each frequency component, wherein said adjustment means adjusts the gain parameters for each frequency component responsive to the residual output for the respective frequency component.

3. The system as in claim 2 wherein said decision and control means outputs control parameter signals such that the gain parameters at the higher frequency components is substantially boosted, wherein the gain parameters at the low frequency components is strongly suppressed, responsive to a determination by the decision and control means that most of the power components of the noise are located below a predefined maximum frequency, wherein the decision and control means determines the noise to be low frequency noise.

4. The system as in claim 3 wherein said increase is performed gradually over a time interval of no more than 1 second when the increase in gain parameters of the filter means over a frequency range to be increased.

5. The system of claim 2 wherein the gain parameter of the filter means is determined responsive to an artificial intelligence subsystem means in the decision and control means which determines when power of the noise is substantially equal over the whole range of the frequencies considered and responsive to said determination it activates a white noise control mode wherein the gain parameters of the highest and the lowest end of the frequency range considered are suppressed.

6. The system as in claim 1 wherein fast-time variations are determined over a frequency range covering a frequency spectrum of speech, including all frequency components.

7. The system of claim 1, wherein said power component is determined at the respective frequency components as a finite sum of discrete time samples of the square of the input signal.

8. The system of claim 1, wherein said frequency components of the input signal are Discrete Fourier Transform transform (DFT) parameters of the input signal, and wherein said decision and control means is further comprised of a DFT analyzer subsystem for selectively outputting said DFT parameters for the input signal responsive to the input signal.

9. The system as in claim 1, wherein said frequency subsystem means is comprised of an array of band pass filters responsive to the input signal.

10. The system as in claim 9, wherein said array of band pass filters simultaneously produces said frequency components outputs of said decision and control means, wherein said outputs from each band pass filter is subsequently passed to said filter means through respective gain elements for each frequency band, wherein gain value is determined responsive to said control parameter signals.

11. The system as in claim 1 wherein fast time variations are determined over frequency ranges each covering a frequency band between 100 Hz and 10,000 HZ.

12. The system as in claim 1, wherein said decision control means activates a babble noise mode wherein at least one low frequency range of the filter is strongly suppressed, wherein at least one high frequency range is amplified, responsive to determining that:

the power of the noise determined by the decision and control means is substantially high at the low end of the frequency range for frequencies up to approximately 1000 Hertz, and at the same time, the power of the noise at the high end of the frequency range is determined to be non-zero, and variations in the power components at said high frequency range are determined to be considerably faster than a pre-determined speed of variation associated with ordinary speech.

13. The system as in claim 12 wherein reduction of said gain parameters are reduced below unity, and suppression occurs gradually and smoothly over a time interval of no more than 1 second when the gain parameters of the filter means over a frequency range is to be suppressed.

14. The system as in claim 1 wherein the decision and control channel determines the noise to be high frequency nose and strongly suppresses the appropriate range of frequencies where the noise lies responsive to determining that the power components of the noise is determined to lie above a predetermined high frequency range.

15. The system as in claim 1, wherein said decision and control means determines the frequency range where said noise power is maximal, and wherein the filter output reduction is highest for said determined maximal frequency range.

16. The system as in claim 15, wherein for frequency ranges other than said determined range, said filter output reduction is less than said highest reduction.

17. The system as in claim 15 wherein said highest filter output reduction is of a value that is higher for lower frequencies.

18. The system as in claim 17 wherein said filter output reduction of low frequency range is made greater than said filter output reduction of a predefined high frequency range responsive to the decision and control means determining that the power component of the noise is present at both the predefined high and low frequency ranges.

19. The system as in claim 18 further comprising:

means for reducing said filter output only at said high and low frequency ranges responsive to said speech signal, responsive to determining that a distribution of the noise components is white noise.

20. The system as in claim 18 further comprising:

means for reducing said filter output only at said low frequency range responsive to said speech signal, responsive to determining that a distribution of the noise components is babble.

21. The system as in claim 1 further comprising:

a feedback channel coupled to receive the output of the filter channel, comprising a voiced/unvoiced discrimination circuit, comprising a high pass and a low pass subfilters with sharp cut-offs for measuring output levels at frequencies above and beyond a predefined threshold frequency;

a decision subsystem responsive to the feedback channel, for providing an output signal Q responsive to determining that signal power at the output of each of said high-pass and low-pass subfilters, over a predetermined time window ($T_w$) of the order of 300 milliseconds, mostly lies in the high pass sub-filter frequency range, at a level above a predetermined level for more than a second predetermined time interval, and for continuing to provide said output during said above first time window $T_w$ until that signal's power is determined to fall below said predetermined level, but not longer than until the end of said first time window $T_w$, and wherein responsive to a determination that the power at the said low-pass subfilter is above a second predetermined level for a third predetermined time that is longer than said second predefined interval an output Q is output, and wherein responsive to power levels at both said high and low pass sub-filters overlapping and simultaneously exceeding threshold levels, an output Q is output for the duration of said overlap of power levels at both said high and low pass subfilters at said threshold level, time window, and wherein the ratio between the duration of the output signal of level Q denoted as $T_q$ and the length of the window denoted $T_w$, namely the ratio $T_q/T_w=R_q$ is repeatedly computed for each window $T_w$, and wherein the gain parameters of each range of frequency of the filter means are slightly varied such that a gradient ratio of change in $R_q$ vs change in each of said parameters is computed to provide a gradient search that can be recursive, in the direction of reducing $R_q$ such that gradient search serves as a gradient search feedback to modify the filter means gains in order to reduce $R_q$, but wherein the latter change in filter channel's gain is limited to be within a predetermined percentage ratio from the respective gain values as determined by the decision and control means without consideration of the feedback channel, to limit the effect of the feedback correction, and wherein the gradient relation of gain $G_i$ for an i'th frequency range, i being a running integer i 1,2, . . . N, N being the total number of frequency ranges considered, versus $R_q$, is updated through applying very small increments to the various gains over a predefined time interval $T_q$ and comparing the change in $R_q$ with respect to its value over the previous such interval $T_q$, this interval $T_q$ not necessarily being equal to $T_w$, and wherein the gradient function is denoted as $$\frac{\delta R_q}{\delta G_i}\ ;\ i = 1, 2, \ldots N$$

δ denoting variation over the time interval $T_q(j)$, denoting the j'th integer time interval; j=0,1,2 . . .

22. The system as in claim 21 wherein the correction change in Gi, between the j'th interval $T_q(j)$ and the previous such interval $T_q(j-1)$, denoted as $G_i(j)$, is given by the recursive relation $$\Delta G_i(j) = \beta \frac{\delta R_q}{\delta G_i} \quad i = 1, 2, \ldots N$$

where $\beta$ is given coefficient but where $$\sum_j \Delta G_i(j),\ \sum_j$$

denoting summation over j does not exceed a predefined threshold ratio relative to $G_j$ as determined by the decision and control means without considerations of when disregarding the feedback channel, i denoting the frequency range considered.

* * * * *